US005259137A

United States Patent [19]

Blenk et al.

[11] Patent Number: 5,259,137

[45] Date of Patent: Nov. 9, 1993

[54] BREECH MECHANISM FOR A FIREARM ESPECIALLY A REPEATER WEAPON

[75] Inventors: Gerhard Blenk, Wertach; Meinrad Zeh, Isny, both of Fed. Rep. of Germany

[73] Assignee: Horst Blaser Jagdwaffenfabrik, Isny, Fed. Rep. of Germany

[21] Appl. No.: 924,192

[22] Filed: Aug. 3, 1992

[30] Foreign Application Priority Data

Sep. 27, 1991 [DE] Fed. Rep. of Germany ... 9112101[U]

[51] Int. Cl.[5] ..... F41A 3/00

[52] U.S. Cl. ..... 42/16; 89/180

[58] Field of Search ..... 42/16, 25; 89/190, 180, 89/176, 168

[56] References Cited

U.S. PATENT DOCUMENTS

| | | | |
|---|---|---|---|
| 2,370,189 | 2/1945 | Denney | 89/190 |
| 3,613,282 | 10/1971 | Ramsay | 42/16 |
| 4,135,434 | 1/1979 | Hürlemann et al. | 89/190 |
| 4,344,246 | 8/1982 | Bauman et al. | 89/168 |

FOREIGN PATENT DOCUMENTS 596649 4/1934 Fed. Rep. of Germany .

*Primary Examiner*—David H. Brown

*Attorney, Agent, or Firm*—Flynn, Thiel, Boutell & Tanis

[57] ABSTRACT

The breech mechanism for a firearm is provided with a breech housing, a locking head connected to the barrel and having a radially inwardly directed conical locking shoulder oriented rearwardly of a cartridge carrier, and a substantially cylindrical breech block movable relative to the breech housing in a direction toward and away from the barrel. A locking sleeve concentrically surrounding the breech block and axially slidable relative thereto to a limited degree, is divided at its front end by a plurality of longitudinal slots into a plurality of spring tongues and carries at the free, front end of each spring tongue a locking element formed in one piece therewith and in the form of an annular segment. Each locking element has a radially outwardly directed cone segment bearing on the locking shoulder in a locking position and having on its front end a radially inwardly directed cone segment with which it bears on a spreading cone arranged in the vicinity of the front end of the breech block. There is further provided an actuating device which, with the breech closed, pushes the locking sleeve axially forwards relative to the breech block.

15 Claims, 5 Drawing Sheets

BREECH MECHANISM FOR A FIREARM ESPECIALLY A REPEATER WEAPON

BACKGROUND OF THE INVENTION (1) Field of the Invention

This invention relates to a breech mechanism for a firearm, especially a repeater weapon, with a breech housing, a locking head connected to the barrel and having a radially inwardly directed conical locking shoulder following the cartridge holder, a substantially cylindrical breech block movable relative to the breech housing in the direction of the barrel, the breech block having a plurality of radially movable locking elements in the form of annular segments in the region of the front end of the breech block, the locking elements having radially outwardly directed cone segment wherewith they bear on the locking shoulder in the locking position and having radially inwardly directed cone segments with which they bear on a spreading cone, a locking sleeve concentrically surrounding the breech block and axially slidable relative thereto to a limited degree, the locking sleeve cooperating with the locking elements, and an actuating device which, with the breech closed, pushes the locking sleeve axially forwards relative to the breech block.

(2) Description of the Prior Art

In such a known breech mechanism (DE 596 649) the locking elements are annular segments of a hollow cylindrical body of revolution. In order to obtain the individual locking elements, a closed hollow cylinder is firstly produced and is then cut up. This has the disadvantage that a number of loose locking elements result for each breech mechanism, which leads to increased assembly costs in the manufacture and servicing of the breech mechanism. Moreover an additional sleeve or the like surrounding the locking elements on the outside is needed, since the locking elements would otherwise fall out when the breech mechanism is open. Furthermore, an increased effort is needed to open the breech mechanism, in order to withdraw the breech block from the locking head, since the locking elements have to be pressed radially inwards through the conical locking shoulder to do this, which is made harder by powder residues which increase the friction.

SUMMARY OF THE INVENTION

The invention is therefore based on the problem of providing a breech mechanism for firearms of the kind initially referred to, which consists of fewer parts, in which the locking elements require no additional assembly costs and in which a smaller effort is required to effect opening.

This is achieved according to the invention in that the locking sleeve is divided at its front end by a plurality of longitudinal slots into a plurality of spring tongues and carries at the free, front end of each spring tongue a locking element formed in one piece therewith, in that the radially inwardly directed cone segments are provided on the front ends of the locking elements and in that the spreading cone is arranged in the vicinity of the front end of the breech block.

The invention thus proceeds from the concept of forming the locking elements as components of the locking sleeve, in one piece therewith. The manufacturing costs are reduced by this, since the locking elements are fixed to the locking sleeve by the spring tongues and no additional sleeve is needed to retain the locking elements with the breech mechanism open. Since the locking elements are fixed to the locking sleeve by the spring tongues, they can be assembled together with the locking sleeve without additional assembly costs. They can also not be lost when cleaning the breech mechanism. In addition a smaller effort is needed to open the breech mechanism. On opening the breech mechanism the locking elements are moved radially inwards by the spring tongues and thus do not hinder the opening of the breech mechanism.

The spring tongues also ensure constant spacings between the locking elements in the peripheral direction and thus ensure a uniform transmission of the forces arising on the locking shoulder when a shot is discharged. Furthermore the breech block and its reaction bottom are centered relative to the barrel axis by the uniform set-up and the spreading cone provided on the breech block. The reaction bottom thus always assumes the same position relative to the barrel axis, which leads to improved firing accuracy. Moreover the similarly aligned cone surfaces on the locking elements, the locking shoulder and the spreading cone facilitate use of the novel breech mechanism even with a recoil loading mechanism.

The simple construction of the novel breech mechanism is also to be stressed, since it consists of only a few bodies of revolution, which can be made without great expense and with high precision.

Advantageous designs of the invention are characterized in the dependent claims.

BRIEF DESCRIPTION OF THE DRAWINGS

The invention is explained in more detail, with reference to the embodiments shown in the drawings. These show.

DESCRIPTION OF THE PREFERRED EMBODIMENTS

Figure 2:
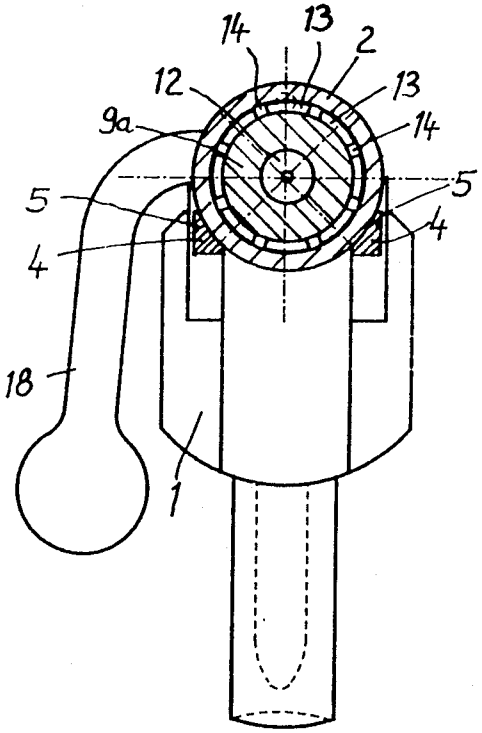
FIG. 2 a cross-section according to the line II—II of FIG. 1.

The invention will now be explained in more detail with reference to a breech mechanism for a repeater weapon. The breech mechanism can however be used for any kind of firearm, e.g. pistols, automatic weapons, air or gas guns and the like.

The breech housing 1 is attached in the usual way to the locking head 2 of the barrel, provided at the rear end of the barrel. This locking head 2 can advantageously consist of one part with the barrel. The bolt 3 is fixed to two rails 4, which are in turn slidable in the direction of the barrel axis A in guides 5 of the breech housing 1. In this manner, the bolt 3 is slidable in the barrel direction relative to the breech housing 1. In a longitudinal bore 6 of the bolt 3 there is arranged the rear end 7*a* of the locking sleeve 7, fixed by the cross part 8. The locking sleeve 7 is therefore in this case fixed to the bolt 3. It surrounds the cylindrical breech block 9 concentrically. The breech block 9 is slidable axially to a small extent within the locking sleeve 7. The sliding movement is limited by the cross part 8, which engages in the longitudinal groove 10 of the breech block 9. The firing pin 12 is slidable in a longitudinal bore 11 of the breech block 9.

The locking sleeve 7 is divided from the front end by a plurality of longitudinal slots 14 into a plurality of spring tongues 7*b*. Each spring tongue 7*b* carries a locking element 13 at its front end, in the form of an annular segment. The locking elements 13 are each in one piece with the associated spring tongue 7*b* and thus with the locking sleeve 7. The locking elements 13 form a ring composed of the annular segments and only interrupted by the slots 14. There are at least four, preferably eight to ten such longitudinal slots 14. The axial length of the longitudinal slots advantageously corresponds to twice the diameter of the locking sleeve 7, in order that the spring tongues 7*b* will be sufficiently springy. The locking sleeve is made from steel.

Figure 3:
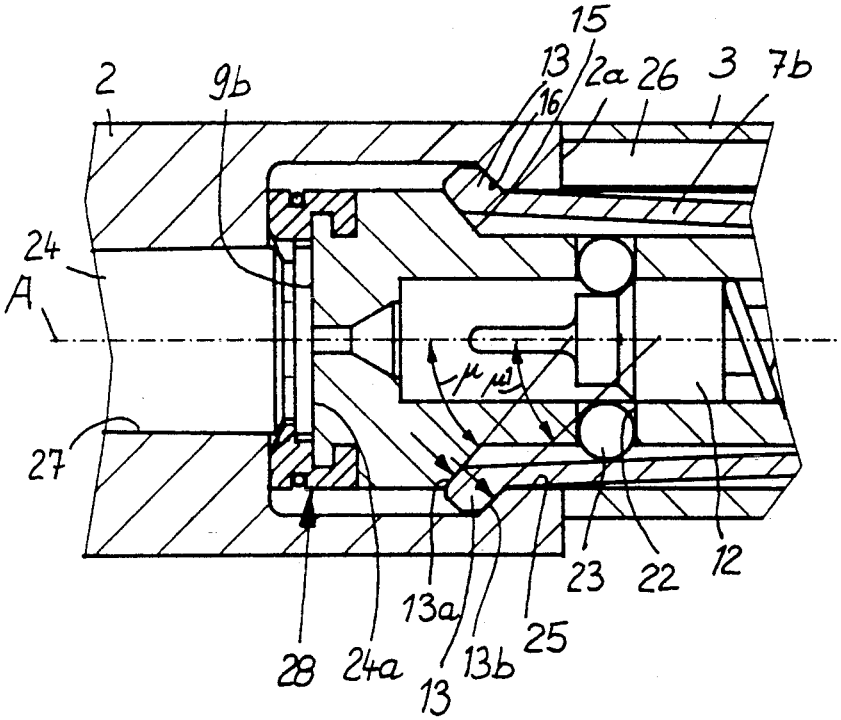
FIG. 3 details of the breech mechanism at the part III of FIG. 1.
Figure 5:
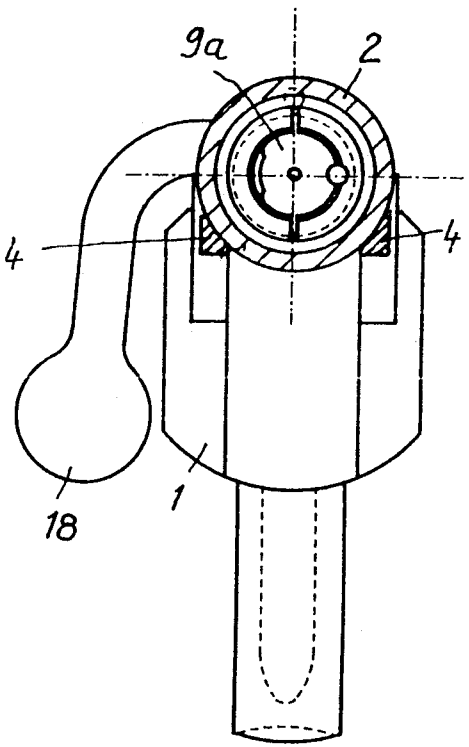

The breech block 9 comprises a spreading cone 15 in the vicinity of its front end 9*a*, this cone tapering to the rear. The locking elements 13 abut this spreading cone 15 by way of radially inwardly directed cone segments 13*a* (FIG. 3). On their sides facing away from the cone segments 13*a*, the locking elements 13 have outwardly directed cone segments 13*b*, which cooperate in the locking position with a locking shoulder 16 of the locking head 2. The locking shoulder 16 is formed by a complete conical surface.

The conical surfaces of the spreading cone 15 and the locking shoulder 16 as well as of the cone segments 13*a* and 13*b* make an angle relative to the barrel axis A of approximately the same cone angle $\mu$ or $\mu l$ in each case, where this cone angle amounts to 30° to 60°, preferably 45°. In the locking position, the cone segments 13*a* should bear on the cone surface of the spreading cone 15 as fully over their area as possible and the cone segments 13*b* should bear on the cone surface of the locking shoulder 16 as fully over their area as possible. In order to achieve this, in the open position of the breech mechanism, in which the spring tongues 7*b* bear according to FIG. 4 on the cylindrical part of the breech block 9, the cone angle of the cone segments 13*a* and 13*b* relative to the barrel axis A is slightly less than the cone angles $\mu$ and $\mu l$ of the cone surfaces of the spreading cone 15 and the locking shoulder 16.

It is moreover advantageous if the cone angle $\mu l$ of the locking shoulder 16 relative to the barrel axis A is smaller by 1° to 3° than the cone angle $\mu$ of the spreading cone 15 relative to the barrel axis A. This facilitates the radially outwards movement of the locking elements 13.

The spindle 18*a* of the actuating lever 18 is moreover pivotally mounted in a transverse bore 17 of the bolt 3. In the embodiment shown in FIGS. 1 to 5 a closing part 19 is fixed to the spindle 18*a* and has an eccentric cam 20. The closing part 19 comprises a recess 19*a* for the passage of the firing pin 12. The eccentric cam 20 cooperates with an inclined face 21*a* of an abutment 21 connected to the breech housing 1.

Figure 4:
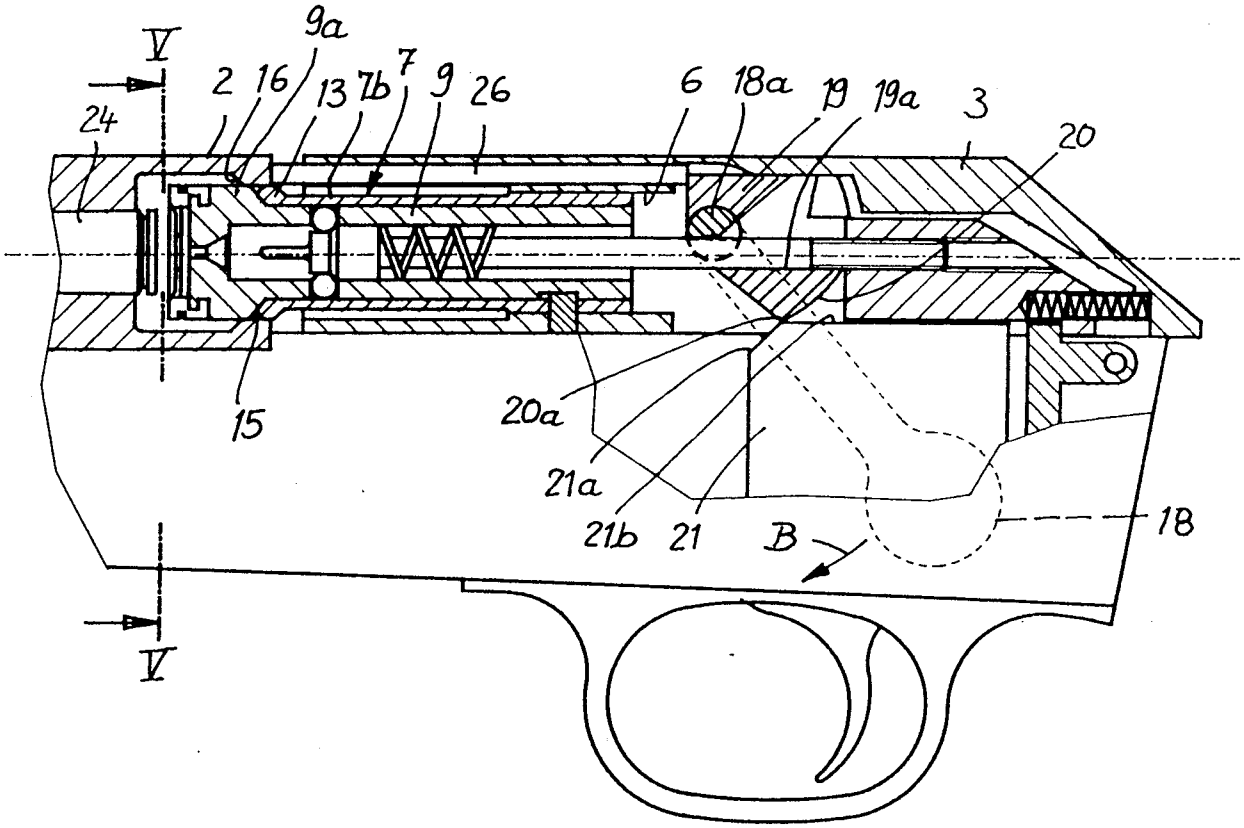
FIG. 4 an axial section in the partially opened position of the breech mechanism, FIG. 5 a section according to the line V—V in FIG. 4, FIG. 6 an axial section of a second embodiment of the breech mechanism in partially opened position, and FIG. 7 an axial section of this second embodiment in locked position.

Furthermore the breech block 9 has two transverse bores 22 in the region of the spring tongues 7*b* of the locking sleeve. In each of these transverse bores 22 there is located a detent ball 23, whose diameter is greater than the wall thickness of the chamber 9. With the breech open, as is shown in FIG. 4, the spring tongues 7*b* bear on the outer peripheral surface of the breech block 9 and thus press the detent balls 23 radially inwards. The detent balls 23 thus project into the path of movement of the firing pin 12 and accordingly prevent the firing pin 12 encountering the percussion cap of the cartridge 24 with the breech open. In the locking position however, the spring tongues 7*b* are lifted off the outer peripheral surface of the breech block 9, as is shown especially in FIG. 3, so that the detent balls 23 can move radially outwards and so no longer prevent the movement of the firing pin 12.

OPERATION

The manner of operation of the breech mechanism is as follows:

With the breech fully or partially open the parts assume the same position as that shown in FIG. 4. The actuating lever 18 is swung to the rear, whereby the eccentric cam 20 is swung so far upwardly that it no longer bears on the inclined face 21*a* of the abutment 21. Accordingly the bolt 3 is free to slide relative to the breech housing 1 in a direction toward and away from the barrel. Moreover the spring tongues 7*b* of the locking sleeve 7 lie on the outer peripheral surface of the breech block 9, on account of their elasticity. The locking elements 13 thus assume their smallest diameter and can easily slide through the bore 25 of the locking head 2.

To close the breech mechanism the bolt 3 is pushed forward by means of the actuating lever 18. The actuating lever 18 cannot be pivoted initially since the edge 20*a* of the eccentric cam 20 slides on the surface 21*b* of the abutment 21 running parallel to the barrel axis A. As soon as the edge 20*a* comes into the region of the inclined surface 21*a*, the eccentric cam 20 becomes operative. By swinging the eccentric cam 20 in the direction B by means of the actuating lever 18, the bolt 3 is forced forwards. In this the reaction bottom 9*b* of the breech block 9 initially comes to bear on the bottom 24*a* of the cartridge case 24. Since further forward movement of the breech block 9 is thereby prevented, the locking sleeve 7 shifts relative to the breech block 9 with further forward movement of the bolt 3. The spreading cone 15 forces the locking elements 13 radially outwards, whereby the rear, radially outwardly directed cone segments 13*b* are pressed against the conical locking shoulder 16. In the closed position the parts assume the position shown in FIGS. 1 and 3. As a result of the abutment of the locking elements 13 on the one hand on the conical locking shoulder 16 and on the other hand on the spreading cone 15, the front end 9*a* of the breech block 9 is centered relative to the barrel axis A, always in the same position. This ensures that the reaction bottom always assumes the same position relative to the case bottom 24*a* of the current cartridge case, whereby a high firing accuracy is achieved. The gas pressure acting on the case bottom 24*a* during the delivery of a shot is transmitted to the front end 9*a* and thence through the spreading cone 15 to the locking elements 13. This in turn transfer the gas pressure to the continuous locking shoulder 16, as is indicated by the arrows in FIG. 3. Since the locking elements 13 formed as annular segments extend over the whole periphery of the annular shoulder 16 and are only interrupted by the relatively narrow longitudinal slots 14, the supporting breech surface of the locking elements 13 is relatively large, so that the novel breech mechanism is also suitable for higher gas pressures. It should be especially noted that the locking head 2 can nevertheless have a relatively small outer diameter.

Figure 1:
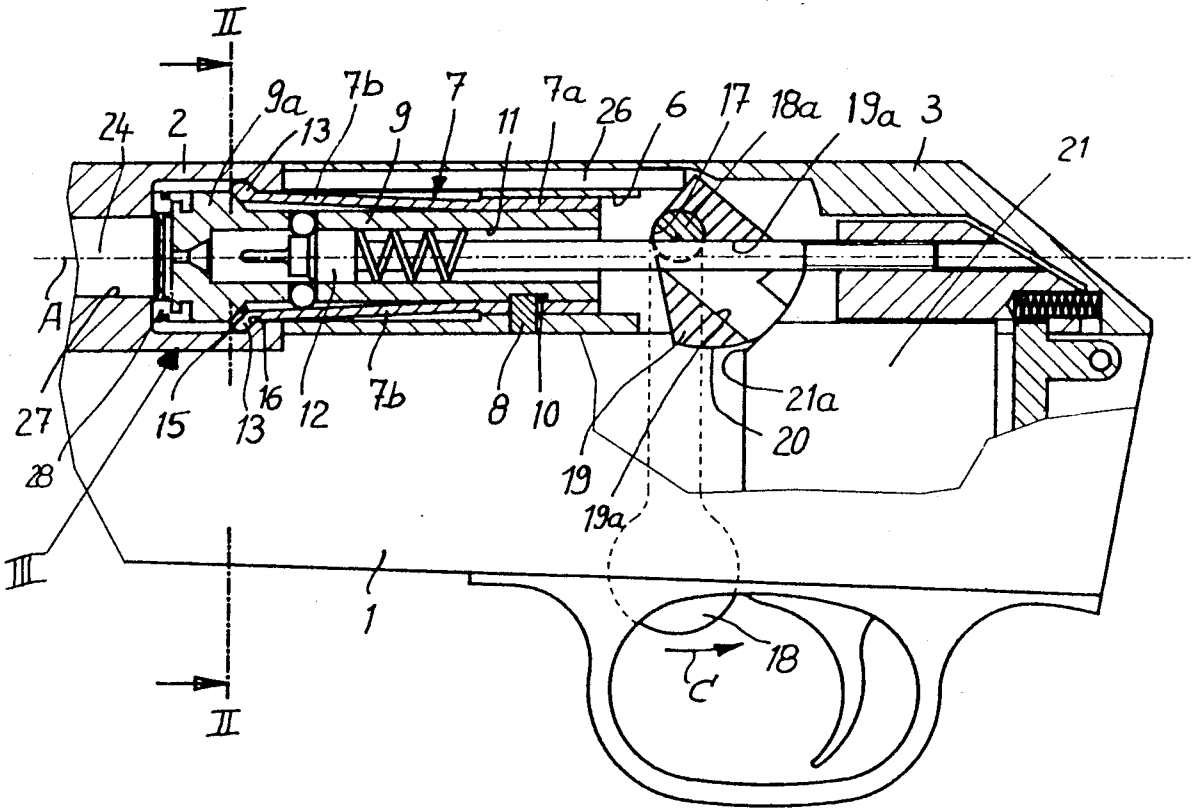
FIG. 1 an axial section through the closed breech mechanism.

To open the breech the actuating lever is swung back in the direction C according to FIG. 1. The closing part 19 hereby presses on the release pin 26, which bears on the rear end 2*a* of the locking head 2. The bolt 3 is thus pushed to the rear and accordingly also the locking sleeve 7 fixed thereto, while the breech block 9 stays in its previous position. As a result the locking elements 13 slide to the rear on the spreading cone 15 and radially inwards, whereby the spring tongues 7*b* of the locking sleeve 7 bear on the outer peripheral surface of the breech block 9 on account of their elasticity. With further movement of the bolt 3 to the rear, the cross part 8 also entrains the breech block 9 and pulls this together with the locking sleeve 7 out of the locking head 2. The bolt 3 can then be moved with the actuating lever 18 so far to the rear that the cartridge case 24 can be withdrawn completely from the cartridge seat 27 of the barrel by the cartridge ejector 28.

Figure 6:
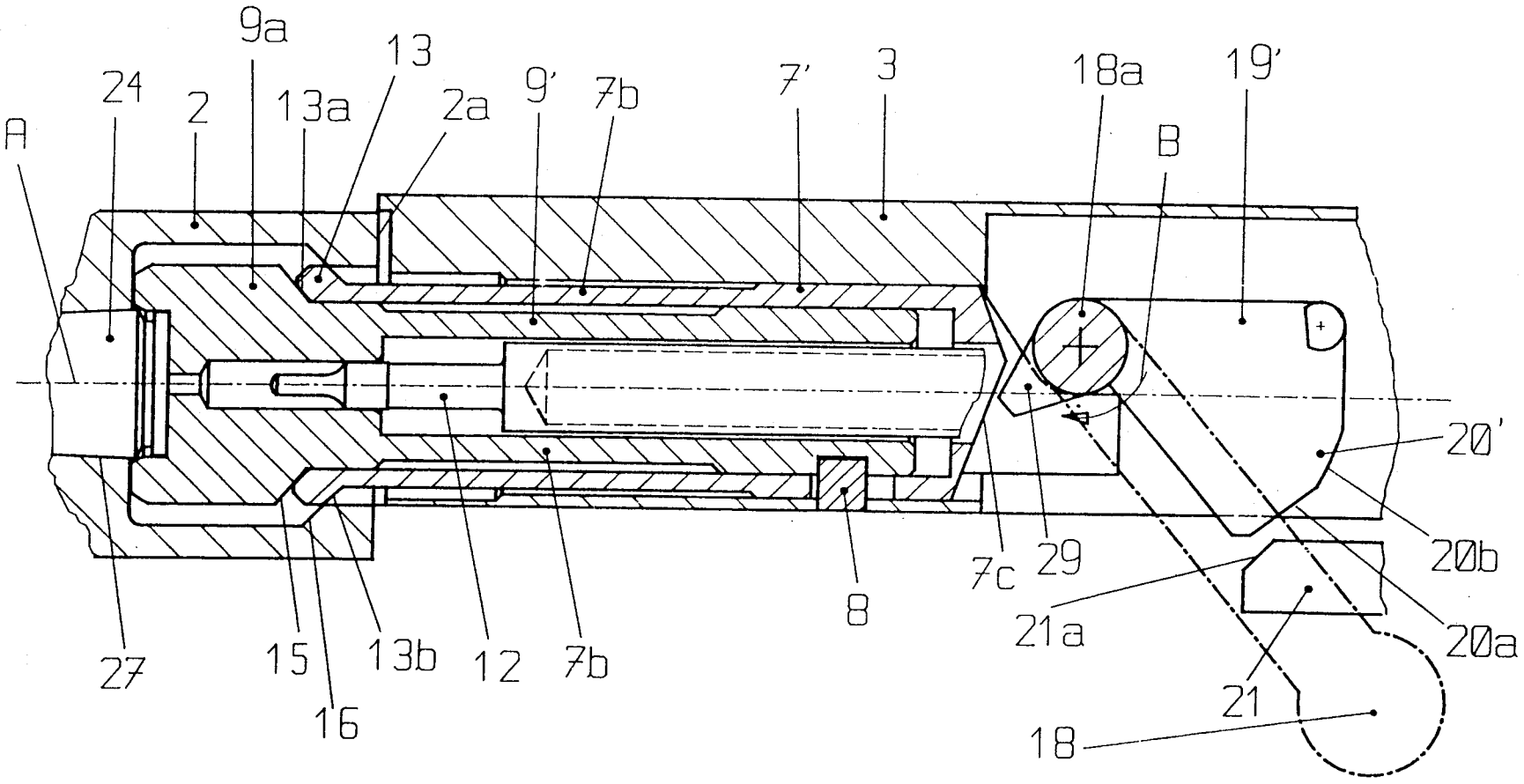
Figure 7:
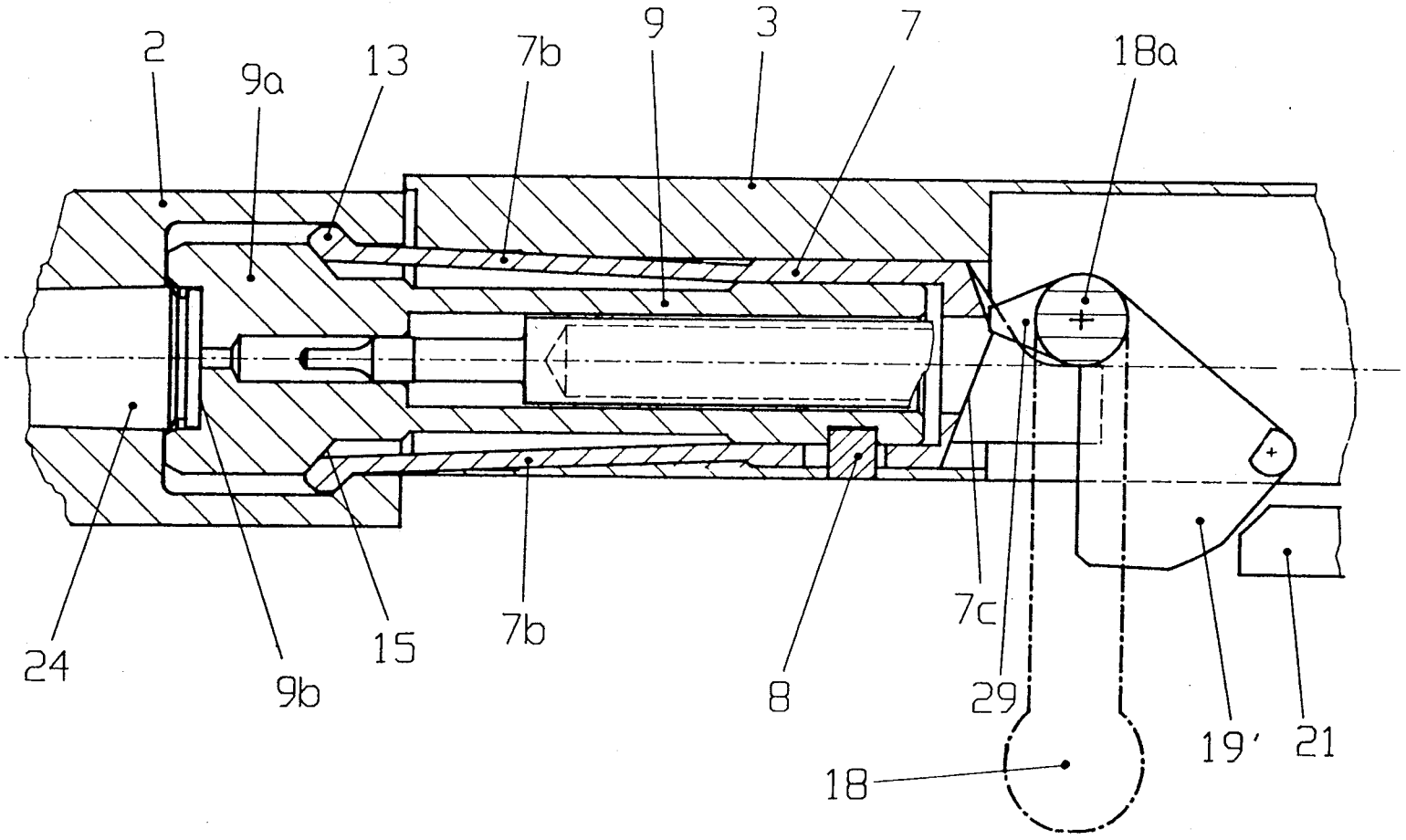

ALTERNATE CONSTRUCTION (FIGS. 6 and 7)

In the embodiment shown in FIGS. 6 and 7 the parts which match in operation the parts of the embodiment previously described are indicated with the same reference numerals and the above description accordingly applies in substance to these parts. In this embodiment of the breech mechanism however, the breech block 9' is connected fast to the bolt 3 by the cross part 8 while the locking sleeve 7' is axially slidable relative to the breech block 9' and also the bolt 3. Furthermore a control cam 29 is connected to the pivotal axis 18*a* of the actuating lever 18 and acts on the rear end 7*c* of the locking sleeve. The closing part 19' has a cam 20' with a first cam section 20*a* eccentric with respect to the pivotal axis 18*a*, its radial spacing from the pivotal axis 18*a* increasing in the locking direction B. A second cam section 20*b* of constant radial spacing continues from this first cam section 20*a*.

To lock the breech mechanism the bolt 3 is pushed forwards by means of the actuating lever 18, whereby the cartridge 24 is partially pressed into the cartridge seat 27 by the reaction bottom 9*b*. When the actuating lever 18 is then swung in the locking direction B, the first, eccentric cam section 20*a* comes into abutment with the inclined surface 21*a* of the abutment 21 and forces the bolt 3 further forwards.

With further swinging of the actuating lever 18 in the direction B, the control cam 29 presses the locking sleeve 7' forwards, whereby the locking elements 13 are forced radially outwards by the spreading cone 15 and come into engagement with the locking shoulder 16 with their radially outwardly directed cone segments 13*b*, which would correspond to FIG. 3. While the control cam 29 forces the locking sleeve 7' forwards, the second cam section 20*b* concentric with the pivotal axis comes into engagement with the inclined surface 21*a*, whereby further forward movement of the bolt 3 is stopped.

The embodiments of the invention in which an exclusive property or privilege is claimed are defined as follows:

1. A breech mechanism for a firearm, comprising a breech housing, a locking head connected to a barrel and having a radially inwardly directed conical locking shoulder oriented rearwardly of a means for holding a cartridge, a substantially cylindrical breech block movable relative to the breech housing toward and away from the barrel, a locking sleeve concentrically surrounding the breech block and being axially slidable relative thereto to a limited degree, the locking sleeve being divided at its front end by a plurality of longitudinal slots into a plurality of spring tongues and carrying at the free, front end of each spring tongue a locking element in the form of an annular segment formed in one piece therewith, each locking element having a radially outwardly directed cone segment bearing on the locking shoulder in a locking position and having on its front end a radially inwardly directed cone segment with which it bears on a spreading cone arranged in the vicinity of the front end of the breech block, and an actuating device for effecting an opening and a closing of the breech mechanism and for, with the breech mechanism closed, pushing the locking sleeve axially forward relative to the breech block.

2. A breech mechanism according to claim 1, wherein the length of the longitudinal slots is at least twice the diameter of the locking sleeve.

3. A breech mechanism according to claim 1, wherein the breech block and locking sleeve are arranged in a bolt movable relative to the breech housing in a direction toward and away from the barrel, the locking sleeve being fixed to the bolt.

4. A breech mechanism according to claim 1, wherein the breech block has at least one transverse bore in a region of the spring tongues of the locking sleeve, and wherein a detent ball is arranged in the transverse bore and has a diameter greater than the wall thickness of the breech block, so that, with the breech open, the detent ball projects into the path of movement of a striking pin slidable in the breech block.

5. A breech mechanism according to claim 1, wherein the firearm is a repeater weapon.

6. A breech mechanism according to claim 1, wherein the breech block and locking sleeve are arranged in a bolt movable relative to the breech housing in a direction toward and away from the barrel, the breech block being fixed to the bolt.

7. A breech mechanism according to claim 1, wherein the spreading cone has a conical surface and, wherein the conical surfaces of the spreading cone and the locking shoulder as well as the cone segments of the locking elements each make approximately the same cone angle relative to the axis of the barrel.

8. A breech mechanism according to claim 7, wherein the cone angle is in the range of 30° to 60°.

9. A breech mechanism according to claim 8, wherein the cone angle is approximately 45°.

10. A breech mechanism according to claim 1, wherein the locking sleeve has at least four longitudinal slots.

11. A breech mechanism according to claim 10, wherein the locking sleeve has eight to ten longitudinal slots.

12. A breech mechanism according to claim 11, wherein a pivoted actuating lever arranged about a pivot axis mounted on the bolt and extending transverse to a longitudinally extending barrel axis, and wherein the actuating lever is connected in driving relationship with a closing part which bears on an abutment of the breech housing in the closed position of the actuating lever.

13. A breech mechanism according to claim 12, wherein the closing part has a cam connected to the actuating lever and which cooperates with the abutment.

14. A breech mechanism according to claim 13, wherein the cam has at least a first cam section extending eccentrically relative to the pivot axis.

15. A breech mechanism according to claim 13, wherein the first cam section extends eccentrically relative to the pivot axis with a radial spacing from the pivot axis increasing in the locking direction, wherein a second cam section with constant radial spacing is provided adjoining the first cam section, and wherein a control cam is arranged on the pivot axis which acts on the rear end of the locking sleeve.

* * * * *